US007764900B2

(12) United States Patent
Hyakutake et al.

(10) Patent No.: US 7,764,900 B2
(45) Date of Patent: Jul. 27, 2010

(54) IMAGE FORMING APPARATUS AND IMAGE FORMING METHOD USING PATCH IMAGES

(75) Inventors: Nobuo Hyakutake, Kanagawa (JP); Taku Fukuhara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 92 days.

(21) Appl. No.: 11/958,124

(22) Filed: Dec. 17, 2007

(65) Prior Publication Data

US 2008/0317495 A1 Dec. 25, 2008

(30) Foreign Application Priority Data

Jun. 25, 2007 (JP) ..... 2007-166513

(51) Int. Cl.
*G03G 15/16* (2006.01)

(52) U.S. Cl. ..... 399/101; 399/99; 399/341

(58) Field of Classification Search ..... 399/101
See application file for complete search history.

(56) References Cited

U.S. PATENT DOCUMENTS 6,681,095 B1 * 1/2004 Tsuda ..... 399/341
6,768,892 B2 * 7/2004 Sawai ..... 399/302
2002/0167681 A1 * 11/2002 Ide et al. ..... 358/1.9

FOREIGN PATENT DOCUMENTS

| | | |
|---|---|---|
| JP | 2002-214871 | 7/2002 |
| JP | 2006-030737 | 2/2006 |
| JP | 2006-163267 | 6/2006 |

* cited by examiner

*Primary Examiner*—David M Gray
*Assistant Examiner*—Roy Yi
(74) *Attorney, Agent, or Firm*—Morgan, Lewis & Bockius LLP

(57) ABSTRACT

An image forming apparatus includes an image carrier that holds a toner-image; an intermediate transfer member onto which the toner-image that has been held on the image carrier is transferred; a transfer unit that transfers onto a recording medium the toner-image that has been transferred onto the intermediate transfer member, the transfer unit transferring thereon a color-toner-image for checking toner-image, which has been formed in a non-image forming region on the intermediate transfer member; an application unit that applies an adhesion force reducing agent to a surface of the transfer unit before the color-toner-image for checking formed on the intermediate transfer member passes through the transfer unit, the adhesion force reducing agent reducing adhesion force to the transfer unit of the color-toner-image for checking; and a cleaning unit that removes the color-toner-image for checking that has been transferred onto the transfer unit and the adhesion force reducing agent.

20 Claims, 14 Drawing Sheets

BACK SIDE FACE SOIL DENSITY

IMAGE FORMING APPARATUS AND IMAGE FORMING METHOD USING PATCH IMAGES

CROSS-REFERENCE TO RELATED APPLICATION

This application is based on and claims priority under 35 U.S.C 119 from Japanese Patent Application No. 2007-166513 filed Jun. 25, 2007.

BACKGROUND

1. Technical Field

The present invention relates to an image forming apparatus and an image forming method.

2. Related Art

In a conventional electrophotographic image forming apparatus, the outer peripheral surface of an image carrier, such as a photoreceptor drum, is charged, then exposed, and by then developing the thus formed electrostatic latent image with toner, the latent image is made visible and a toner image is formed on the image carrier. An image is then formed on a recording medium by transferring the toner image onto a recording medium, such as paper or the like, and fixing the toner image.

SUMMARY

According to an aspect of the invention, there is provided an image forming apparatus including: an image carrier that holds a toner image; an intermediate transfer member onto which the toner image that has been held on the image carrier is transferred; a transfer unit that transfers onto a recording medium the toner image that has been transferred onto the intermediate transfer member, the transfer unit transferring thereon a color toner image for checking the toner image, which has been formed in a non-image forming region on the intermediate transfer member; an application unit that applies an adhesion force reducing agent to a surface of the transfer unit before the color toner image for checking the toner image formed on the intermediate transfer member passes through the transfer unit, the adhesion force reducing agent reducing adhesion force to the transfer unit of the color toner image for checking the toner image; and a cleaning unit that removes the color toner image for checking the toner image that has been transferred onto the transfer unit and the adhesion force reducing agent.

BRIEF DESCRIPTION OF THE DRAWINGS

Exemplary embodiments of the present invention will be described in detail based on the following figures, wherein.

DETAILED DESCRIPTION

Explanation will now be given of an image forming apparatus according to exemplary embodiments of the present invention, with reference to the drawings.

Figure 1:
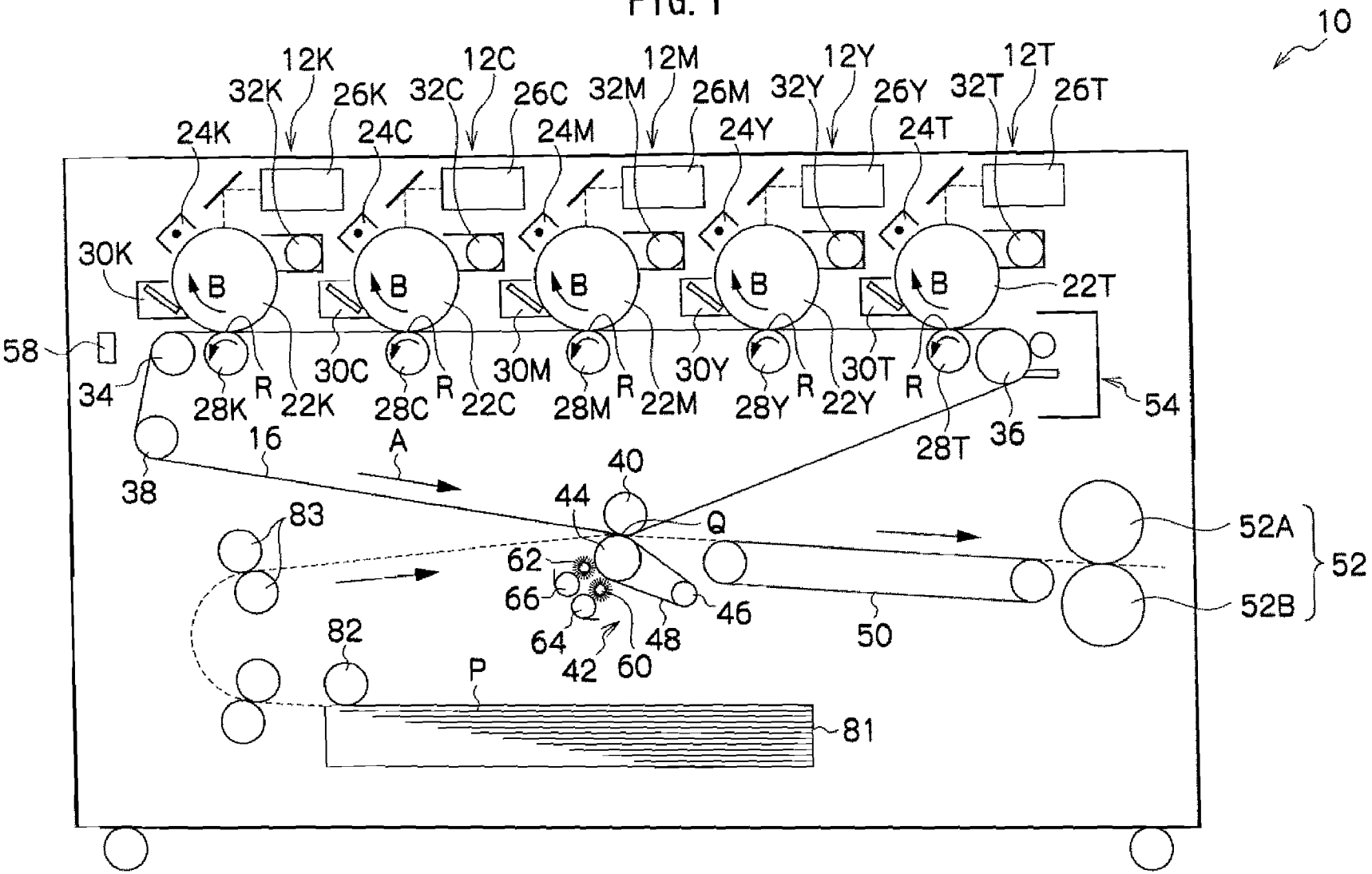
FIG. 1 is an outline view showing a configuration of an image forming apparatus according to an exemplary embodiment of the present invention.

FIG. 1 shows, in outline, a configuration of an image forming apparatus 10. An endless belt-shaped intermediate transfer belt 16 extends across an upper portion of the image forming apparatus 10, entrained around plural (four in this exemplary embodiment) support rolls 34 to 40 (described later). The intermediate transfer belt 16 is driven by a motor (not shown in the drawings) so as to be transported in the direction of arrow A, and there are plural image forming units 12 (details of which will be described later) disposed at the upper portion of the intermediate transfer belt 16, the image forming units 12 being disposed along the transporting direction of the intermediate transfer belt 16.

There are image forming units 12Y, 12M, 12C, and 12K, disposed respectively in the image forming apparatus 10, which are for the forming of color image according to the present exemplary embodiment. The image forming units 12Y, 12M, 12C form respectively toner images corresponding to the four colors yellow (Y), magenta (M), cyan (C) and black (K).

When it is necessary to distinguish between T (described later), Y, M, C and K, below explanation will be made with the allocation of one or other of T, Y, M, C or K after the reference numeral, however when it is not necessary to so distinguish between T, Y, M, C and K, then T, Y, M, C or K will be omitted.

In addition to the image forming units 12Y, 12M, 12C, and 12K for color image forming, an image forming unit 12T (application unit) for forming an image of transparent toner as adhesion reducing agent is disposed at the upstream side in the intermediate transfer belt 16 transporting direction of the image forming unit 12Y.

Each of the image forming units 12 (it should be noted that the configurations of each of the image forming units 12 are similar to each other, and therefore explanation will be given omitting the suffixes to reference numerals for designating the colors) is disposed so as to contact the intermediate transfer belt 16, and each is provided with a photoreceptor drum 22 that rotates at a given velocity in the direction of arrow B.

There is a charging device 24, for charging the photoreceptor drum 22, disposed at the periphery of the photoreceptor drum 22. The charging device 24 uses a corotron charging device unit or the like (referred to below as "charging device unit 24") and directs ions generated by corona discharge onto the surface of the photoreceptor drum 22, uniformly charging the surface of the photoreceptor drum 22 to a predetermined potential.

It should be noted that as a charging device unit, as well as a charging device such as that above, a charging roll 24 may also be used for charging the surface of the photoreceptor drum 22, by contacting the peripheral surface of the photoreceptor drum 22 and following the rotation of the photoreceptor drum 22.

There is an exposing device 26 disposed at the downstream side in the rotation direction B of photoreceptor drum 22 from the charging device 24. The exposing device 26 is configured with an LED array of plural LEDs (light emitting diodes) that have been arrayed, and the exposing device 26 modulates light beam according to image data, and irradiates the light beam onto the photoreceptor drum 22 that has been uniformly charged by the charging device 24. An electrostatic latent image is thereby formed on the photoreceptor drum 22.

It should be noted that any device that is able to write an image with light to the surface of the photoreceptor drum 22 is suitable for the exposing device 26, and the exposing device 26 is not limited to a device using LEDs, but a print head using EL, or a scanner with a polygon mirror that scans laser beam, or the like, may also be used.

There is a developing device 32 disposed downstream in the rotation direction B of the photoreceptor drum 22 from the exposing device 26. Toner is supplied from the developing device 32 to the photoreceptor drum 22, developing the electrostatic latent image formed on the photoreceptor drum 22 and forming a toner image.

There is also a primary transfer roll 28 disposed downstream in the rotation direction B of the photoreceptor drum 22 from the developing device 32. There is a voltage, of the reverse polarity with respect to that of the charge of the toner, applied to the primary transfer roll 28, and the primary transfer roll 28 transfers toner that is on the photoreceptor drum 22 onto the intermediate transfer belt 16.

The toner images of different colors from each other, which are formed by each of the image forming units 12, are respectively transferred onto the intermediate transfer belt 16 so that they are superimposed on each other. A color toner image is thereby formed on the intermediate transfer belt 16.

There is a cleaning blade 30 disposed downstream in the rotation direction B of the photoreceptor drum 22 from the primary transfer roll 28. The cleaning blade 30 removes, by contact with the surface of the photoreceptor drum 22, any remaining toner remained on the photoreceptor drum 22 that has not been able to be transferred onto the intermediate transfer belt 16 by the primary transfer roll 28.

It should be noted that in the above the cleaning blade 30 is used, however, any cleaning device may be used as long as it is able to cleanout remaining toner on the photoreceptor drum 22, and the cleaning method and materials may be appropriately selected.

In the support rolls 34 to 40 around which the intermediate transfer belt 16 is entrained, the support roll 36 is used as a drive roll, driven by a motor, and the support roll 34 is used as a following roll (a driven roll). The support roll 38 is used as a correcting roll for restricting snaking moving (tortuous moving) in the direction that is substantially orthogonal to the movement direction of the intermediate transfer belt 16, and the support roll 40 is used as a back-up roll for a secondary transfer unit 42. This support roll 40 will be referred to below as a back-up roll 40.

The secondary transfer unit 42 is provided with a secondary transfer roll 44 that is disposed contact-pressing against a toner retaining face of the intermediate transfer belt 16, and when a voltage, which is of the reverse polarity with respect to the charge polarity of the toner, is applied to the secondary transfer roll 44 (a voltage of the same polarity to the charge polarity of the toner may also be applied to the back-up roll 40), the unfixed toner image that has been held on the intermediate transfer belt 16 is secondary-transferred to the paper P at the secondary transfer portion Q by a transfer electric field that is formed between the back-up roll 40 and the secondary transfer roll 44.

The paper P is accommodated in a supply tray 81, and after being supplied by a pick-up roll 82, the paper P is guided, via a registration roll 83, to the secondary transfer portion Q where the toner image held on the intermediate transfer belt 16 is secondary-transferred onto the paper P.

In the secondary transfer unit 42 there is a support roll 46 provided as well as the secondary transfer roll 44, and a paper separation belt 48 (a transfer unit) is entrained around the secondary transfer roll 44 and the support roll 46. The paper P to which the toner image that is on the intermediate transfer belt 16 has been secondary-transferred is guided by a transporting belt 50, described later, and since electrostatic attraction acts, on the paper that has been contact-pressed in the transfer region, toward the intermediate transfer belt 16, by providing the paper separation belt 48 to the secondary transfer unit 42 for stabilizing the attitude of the paper in the transfer region, secondary-transferred to the paper P may be realized at the same time as separation of the paper P from the intermediate transfer belt 16.

The paper P that has been secondary-transferred onto and separated from the intermediate transfer belt 16 is transported to a fixing unit 52 by the transporting belt 50 that is disposed in the vicinity of the secondary transfer portion Q, and toner on the paper P is fused and fixed by nipping and transporting the paper P between a pressing roll 52A and a heating roll 52B. The paper P that has been formed with a desired image thereon is thereby ejected out from the image forming apparatus 10.

Toner that has, however, remained on the intermediate transfer belt 16 after secondary-transfer is removed by a belt cleaner 54 that is disposed on the opposite side to the side of the support roll 36, the intermediate transfer belt 16 passing between the belt cleaner 54 and the support roll 36.

In the image forming apparatus 10, in order to detect the density of each of the toner images, so-called patch images 56 (color toner images for detection) are formed in a non-image forming region of the intermediate transfer belt 16. A detector 58 is disposed, positioned facing the surface of the intermediate transfer belt 16, at the support roll 34 side, so as to be able to detect the density of the patch image.

This detector 58 is connected to a control unit, not shown in the drawings, and the density of each of the toner images can be adjusted by, for example, controlling the laser power of light beams irradiated onto the photoreceptor drums 22 such that the density of the patch image detected by the detector 58 falls within a predetermined set density range.

Apart from adjusting the density of the toner images, the patch images 56 may also be used for adjusting (correcting) misregistration of each of the toner images. When so doing, a misregistration amount computation unit (not illustrated in the drawings) is provided for computing the misregistration amount of the light beam, and the misregistration of the toner image is adjusted, by correcting the timing of writing of the image based on the misregistration amount of the light beam that has been computed by the misregistration computation unit and correcting misregistration of the light beam in the main scanning direction, or the like.

The patch image 56 is transferred to the paper separation belt 48 by the action of the secondary transfer roll 44 that is applied with the voltage which is of the reverse polarity with respect to the charge polarity of the color toner used in the patch image 56. In the secondary transfer unit 42, there are biasing brushes 60 and 62 (cleaning units) disposed on the downstream side in the transporting direction of the paper separation belt 48, in the vicinity of the secondary transfer roll 44, the biasing brushes 60 and 62 being disposed so that they are each able to contact the paper separation belt 48.

Since the biasing brushes 60 and 62 are applied with a voltage that is of the reverse polarity with respect to the charge polarity of the color toner used in the patch image 56, the patch image 56 may be removed from the paper separation belt 48 by the biasing brushes 60 and 62.

When this is being carried out, the polarity of the charge on the toner may be a negative charge or may be a positive charge due to the voltage applied in the secondary transfer portion Q, and the biasing brush 60 and the biasing brush 62 may be applied with voltages that are of the different polarity to each other. A single biasing brush may also be used.

There are toner collecting rolls 64 and 66 disposed, respectively, on the opposite sides of the biasing brushes 60 and 62 to that of the secondary transfer roll 44. The toner collecting rolls 64 and 66 are in contact with the outer peripheral faces of the biasing brushes 60 and 62 and are provided so as to be able to rotationally be driven. The toner collecting rolls 64 and 66 collects toner from the biasing brushes 60 and 62 in contacting the outer peripheral face of the biasing brushes 60 and 62.

Explanation will now be given of the operation of the image forming apparatuses according to exemplary embodiments of the present invention.

The image forming units 12 shown in FIG. 1 (except for the image forming unit 12T) are driven according to respective digital image date input from an image signal processing unit not shown in the drawings. The surface of the photoreceptor drum 22 in each of the image forming units 12 is uniformly charged by the charging device 24, and the photoreceptor drum 22 is irradiated, according to the image data, by the exposing device 26, and the electrostatic latent images are formed on the surfaces of the photoreceptor drums 22.

These respective electrostatic latent images are developed by the developing devices 32 in which respective color toners are accommodated, and toner images are formed of each of the colors. At primary transfer portions R, where each of the photoreceptor drums 22 and the intermediate transfer belt 16 are in contact, by the primary transfer rolls 28 to which a voltage (primary transfer bias) that is of the reverse polarity with respect to that of the charge of the toner is applied, the toner images formed on each of the photoreceptor drums 22 are transferred in sequence onto the intermediate transfer belt 16 from the photoreceptor drums 22.

The toner images which are primary transferred in this manner onto the intermediate transfer belt 16 are superimposed on each other on the intermediate transfer belt 16, and conveyed by the rotation of the intermediate transfer belt 16 to the secondary transfer portion Q.

The paper P is fed out to the secondary transfer portion Q with a predetermined timing. Then, in the secondary transfer portion Q, a voltage is applied (secondary transfer bias) of the reverse polarity with respect to the polarity of the charge of the toner to the secondary transfer roll 44 of the secondary transfer unit 42, and the toner image held on the intermediate transfer belt 16 is secondary-transferred (secondary transferred) to the paper P by the action of a transfer electric field formed between the secondary transfer roll 44 and the back-up roll 40. The paper P that the toner image has been transferred onto is then transported by the transporting belt 50 to the fixing unit 52, and after fixing is carried out, the paper P is ejected out from the image forming apparatus 10.

Figure 2:
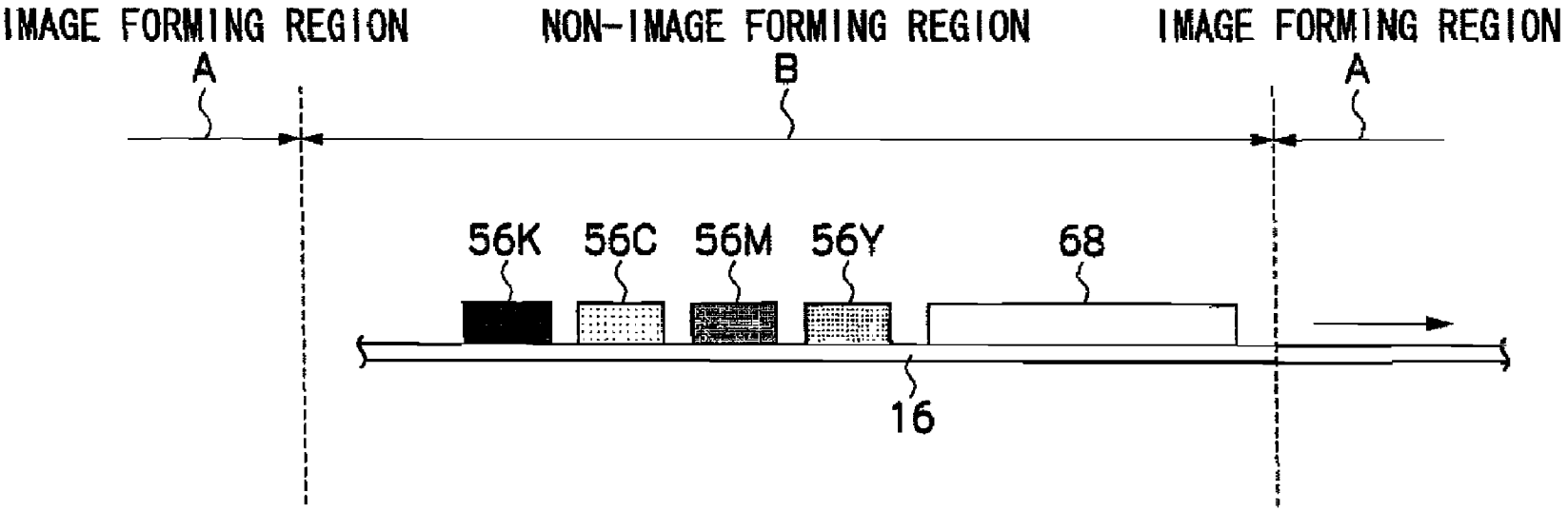
FIG. 2 is a side view showing a state in which patch images have been formed on an intermediate transfer belt of an image forming apparatus according to an exemplary embodiment of the present invention.

As shown in FIG. 2, in order to detect the density and the like of each of the toner images, the patch images 56 are formed at a non image forming region B that is positioned between one image forming region A and another image forming region A. In this case, first, a transparent toner image 68 is formed by the image forming unit 12T. Then a yellow patch image 56Y, a magenta patch image 56M, a cyan patch image 56C and a black patch image 56K are formed in sequence at the upstream side of the transparent toner image 68.

Figure 3:
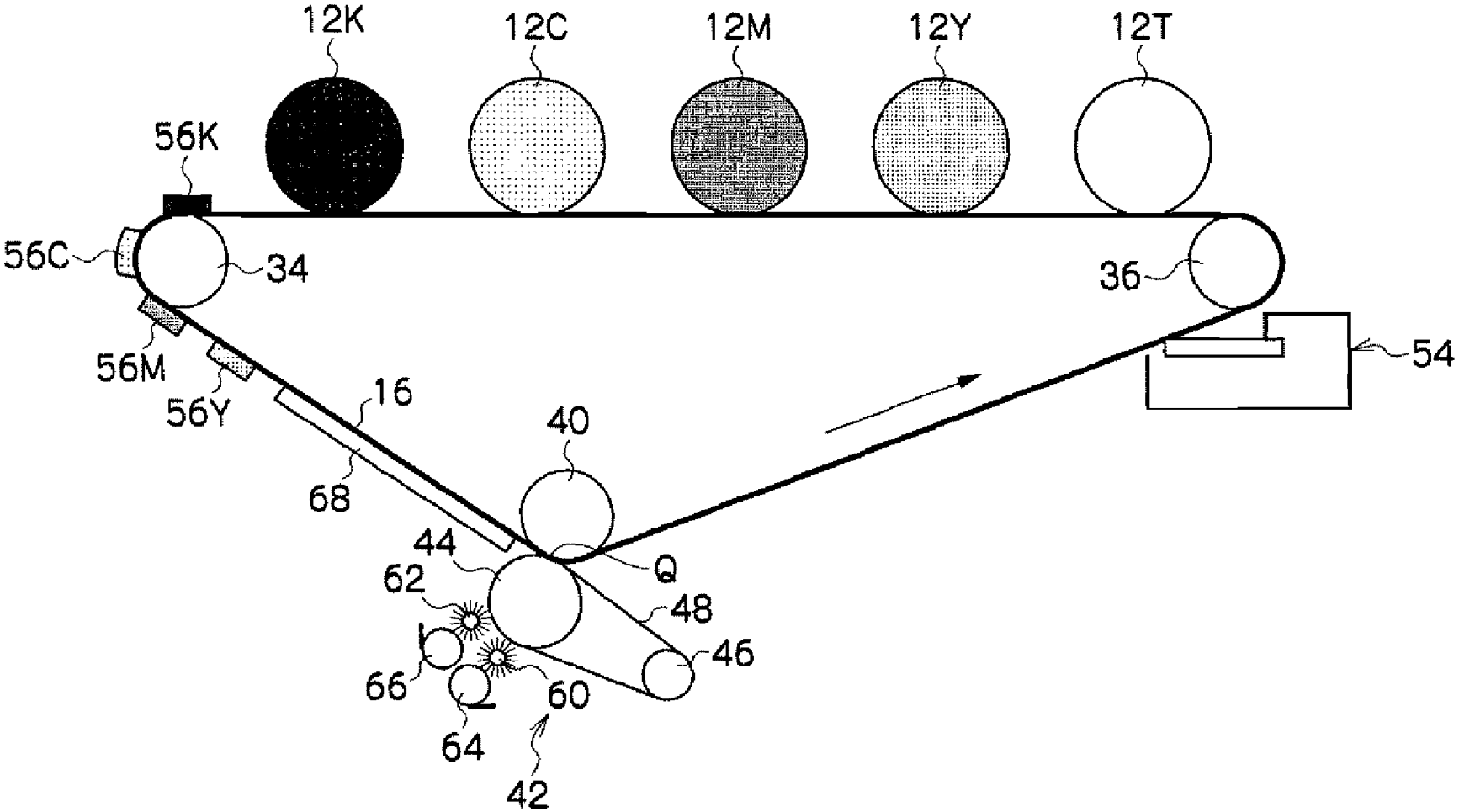
FIG. 3 is a side view showing relevant portions of an image forming apparatus according to an exemplary embodiment of the present invention.

Then, as shown in FIG. 3, when the transparent toner image 68 on the intermediate transfer belt 16 passes through the secondary transfer portion Q, a voltage (the secondary transfer bias), with a polarity that is of the reverse polarity with respect to the charge polarity of the toner, is applied to the secondary transfer roll 44, and the transparent toner image 68 is transferred onto the paper separation belt 48.

The biasing brushes 60 and 62 are disposed at the paper separation belt 48, but, as described later, when the transparent toner image 68 passes through in the state in which the patch images 56 have not been transferred, a voltage that is of the same polarity to the charge polarity of the toner is applied to the biasing brushes 60 and 62 (if the biasing brushes 60 and 62 can be moved so as to be apart from the paper separation belt 48, the biasing brushes 60 and 62 are separated from the paper separation belt 48), such that the transparent toner image 68 on the paper separation belt 48 is not removed.

Figure 4:
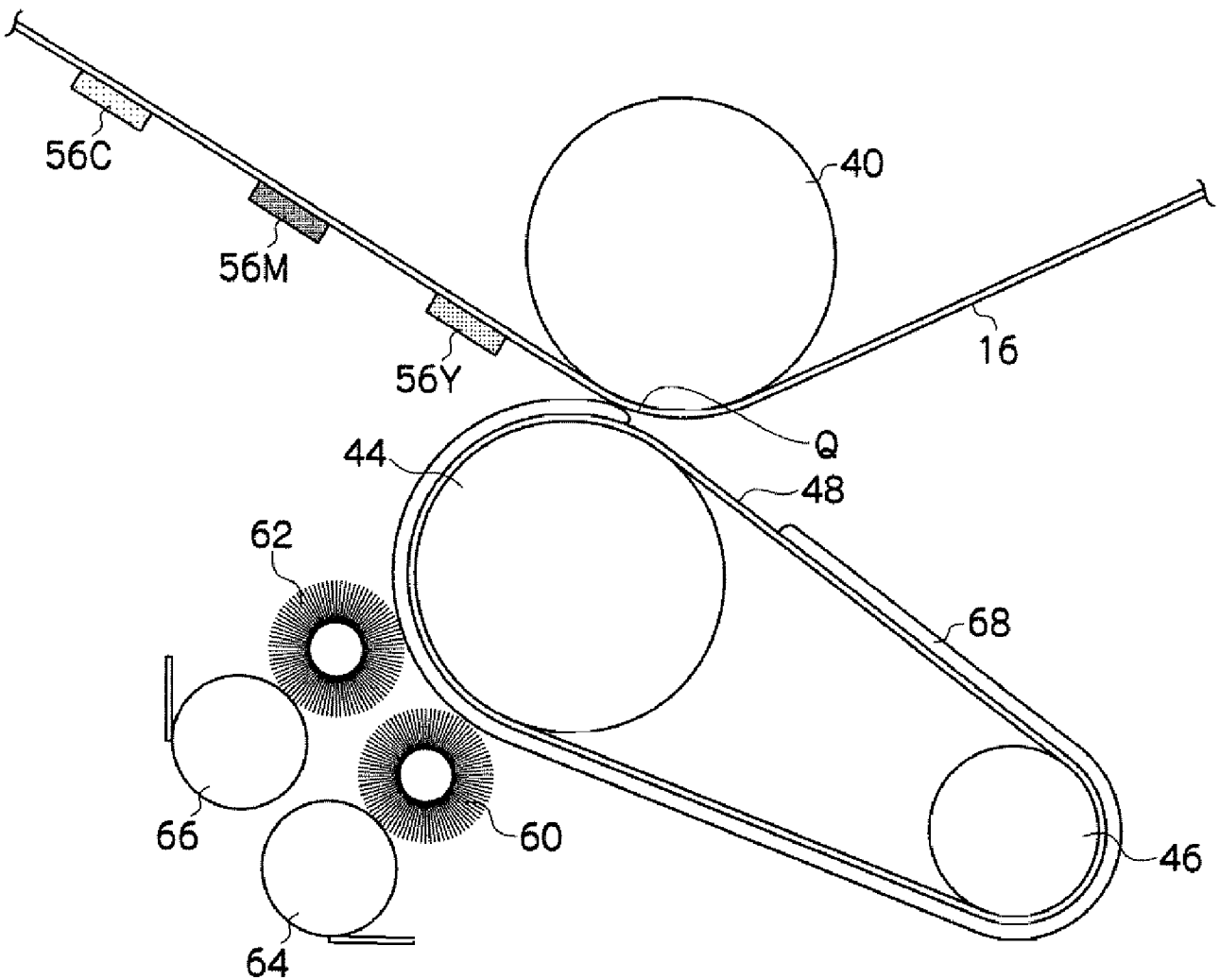
FIG. 4 is an enlarged view of FIG. 3, for explaining the operation of an image forming apparatus according to an exemplary embodiment of the present invention.

As shown in FIG. 4, the length of the transparent toner image 68 is set to be slightly shorter than one rotation equivalent of the paper separation belt 48 (the length of the transparent toner image 68 may be set to one rotation equivalent of the paper separation belt 48), and when the yellow patch image 56Y that is formed next after transparent toner image 68 reaches the secondary transfer portion Q, the yellow patch image 56Y faces the transparent toner image 68.

Figure 5:
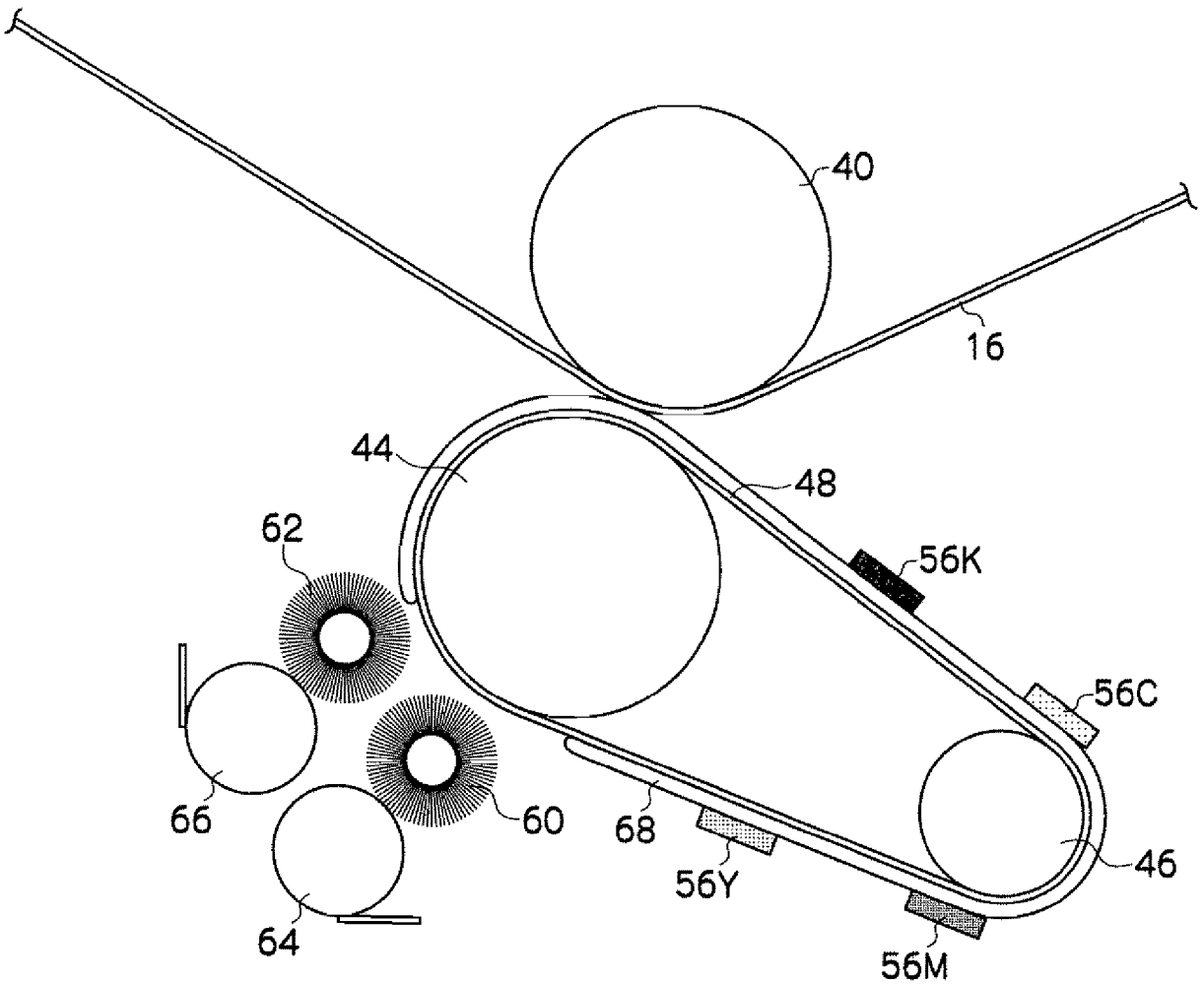
FIG. 5 is an enlarged view of FIG. 3, for explaining the operation of an image forming apparatus according to an exemplary embodiment of the present invention.

Therefore, as shown in FIG. 5, the patch image 56Y is transferred, from the intermediate transfer belt 16, onto the transparent toner image 68 that is on the paper separation belt 48. The patch images 56M, 56C, and 56K are transferred in a similar manner to that of the yellow patch image 56Y.

When all of the patch images 56 (areas where the patch images 56Y, M, C, K are formed) have been transferred onto the transparent toner image 68, a voltage that is of the reverse polarity with respect to the charge polarity of the color toner is applied to the biasing brushes 60 and 62. The patch images 56 are thereby adhered to the biasing brushes 60 and 62, and removed from the paper separation belt 48. Then the color toner (patch images 56) that has adhered to the biasing brushes 60 and 62 is collected by the toner collecting rolls 64 and 66 that contact with the outer peripheral face of the biasing brushes 60 and 62.

When this is being carried out, after the patch images 56 have been formed on the intermediate transfer belt 16, the patch images 56 pass through the secondary transfer portion Q and are transferred onto the paper separation belt 48. However, if the patch images 56 on the paper separation belt 48 are not completely cleaned off, then toner may dirty the back side face of the next sheet of paper.

In a case in which the print speed of the image forming apparatus 10 is slow, the bias applied to the secondary transfer roll 44 may be switched, at the non image forming region B, to the reverse bias and the voltage applied to the secondary transfer roll 44 is then of the same polarity to the charge polarity of the color toners used in the patch images 56, the strength of adhesion of the patch images 56 to the paper separation belt 48 may be reduced.

However, in a case in which the print speed of the image forming apparatus 10 is fast, it becomes difficult to switch over the bias applied to the secondary transfer roll 44 since the time for switching between the image forming region A and the non image forming region B is short, and so bias of the non image forming region B becomes the same as that of the image forming region A, and considerable amounts of toner are transferred to the surface of the paper separation belt 48, with the back side face of the sheet of paper becoming soiled.

Therefore, in the present exemplary embodiment, as shown in FIG. 2, there is the transparent toner image 68 formed to the downstream side of each of the patch images 56Y, M, C, K in the non image forming region B. Due to, after the transparent toner image 68 is transferred onto the paper separation belt 48, transferring the patch images 56 onto the transparent toner image 68, since there is not direct contact of the patch images 56 with the paper separation belt 48, the adhesion force, such as the Van der Waals' force, becomes weak, in comparison with a case in which the patch images 56 directly contacts with the paper separation belt 48.

Figure 6B:
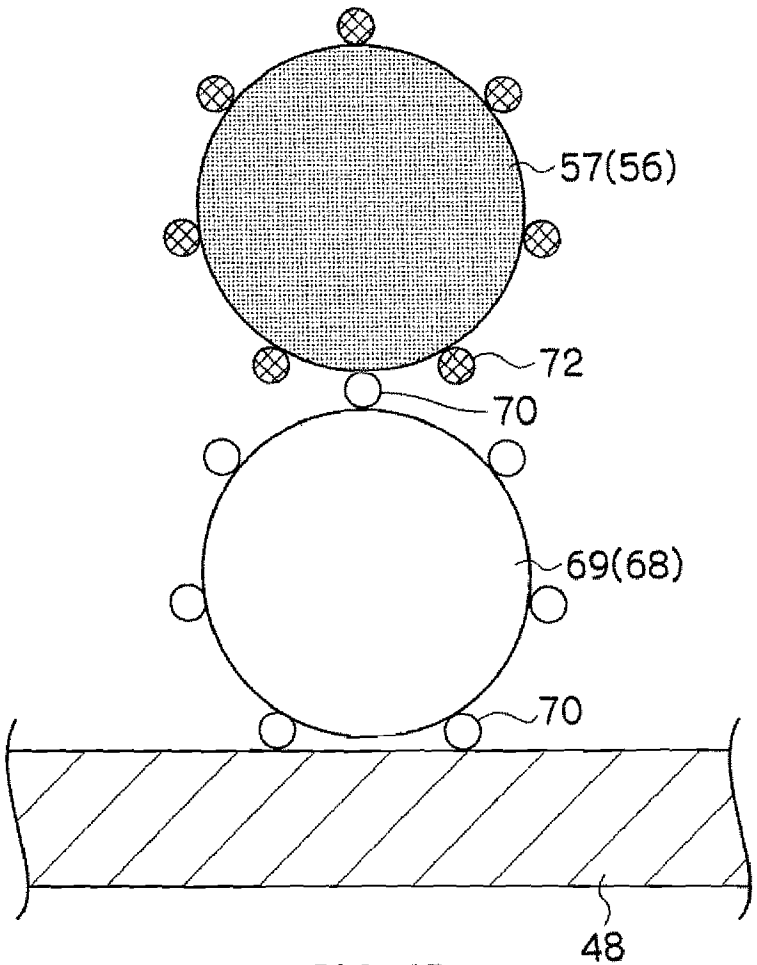
FIG. 6B is an explanatory diagram for explaining the operation of an image forming apparatus according to an exemplary embodiment of the present invention.
Figure 6A:
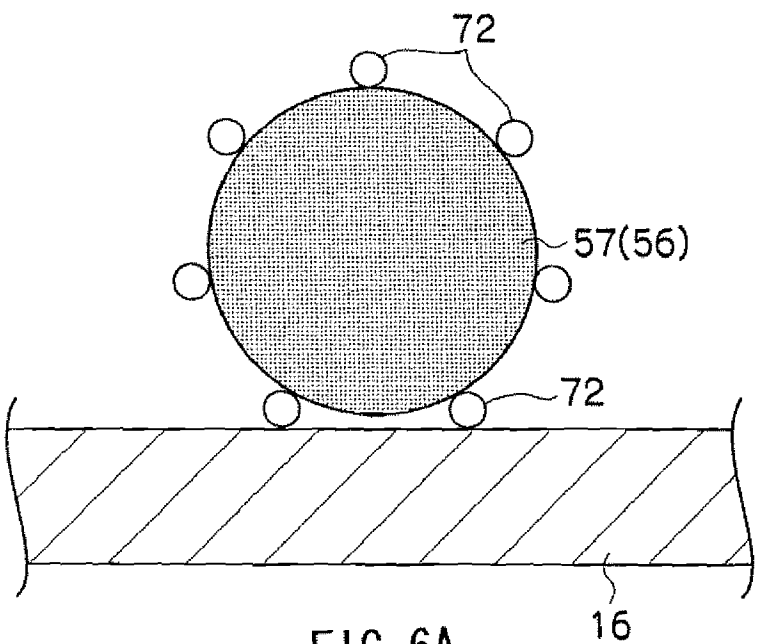
FIG. 6A is a comparative example to FIG. 6B.

That is to say, as shown in FIG. 6A, an external additive 72, such as silica or the like, is included in a toner 57 in order to increase the adhesion force thereof to the intermediate transfer belt 16 and the like, but, as shown in FIG. 6B, by transferring the patch image 56 onto the transparent toner image 68, there is sufficient presence of the external additive 72 between a transparent toner 69 and the color toner 57, due to the external additive 70 of the transparent toner 69 and the external additive 72 of the color toner 57, thereby achieving a reduction in the adhesion force. Further, relatively, the contact area in a case of contact of the color toner 57 with the transparent toner 69 becomes less than that in a case of contact of the toner 57 with the paper separation belt 48. Therefore, the adhesion force of the patch image 56 to the transparent toner image 68 is therefore less.

Hence, in the state in which a voltage is applied to the biasing brushes 60 and 62 that is of the reverse polarity with respect to the color toner charge polarity for the patch image 56, the patch images 56 formed on the paper separation belt 48 are substantially removed.

In other words, as shown in FIG. 5, by adhering transparent toner image 68 between the paper separation belt 48 and the patch images 56, the Van der Waals' force between the paper separation belt 48 and the patch images 56 is reduced, and the patch images 56 may be readily removed from the paper separation belt 48.

It therefore becomes easy to remove the patch images 56 using the biasing brushes 60 and 62. It should be noted that, after passing through the biasing brushes 60 and 62, there may be localized portions on the surface of the paper separation belt 48 where cleaning of the transparent toner image 68 is not complete, however these are not of the extent to cause a problem of dirty of the back side face of the paper P.

In the case in which the print speed becomes fast, switching of the bias applied to the secondary transfer roll 44 between the image forming region A and the non image forming region B becomes difficult, but by applying transparent toner image 68 between the paper separation belt 48 and the patch images 56, the patch images 56 removal is facilitated, and therefore the patch images 56 are removed, even if it is not possible to switch the bias applied to the secondary transfer roll 44 to the reverse bias in the non image forming regions B.

In the case in which the print speed is slow, the bias applied to the secondary transfer roll 44 is switched to the reverse bias in the non image forming region B, and since a voltage is applied to the secondary transfer roll 44 that is of the same polarity as that of the color toner charge polarity, by adhering the transparent toner image 68 between the paper separation belt 48 and the patch images 56, in addition to reducing the Van der Waals' force between the paper separation belt 48 and the patch images 56, the adhesion force of the patch images 56 to the paper separation belt 48 is reduced, and so the patch images 56 is readily removed from the paper separation belt 48.

The transparent toner image 68 is transferred to the surface of the paper separation belt 48 in order to suppress dirty of the back side face of the paper P by the patch images 56, however, the thickness of the transparent toner image 68 is also important. The relationship between the amount of transparent toner and the density of dirty of the back side face of the paper is shown in FIG. 7.

Figure 7:
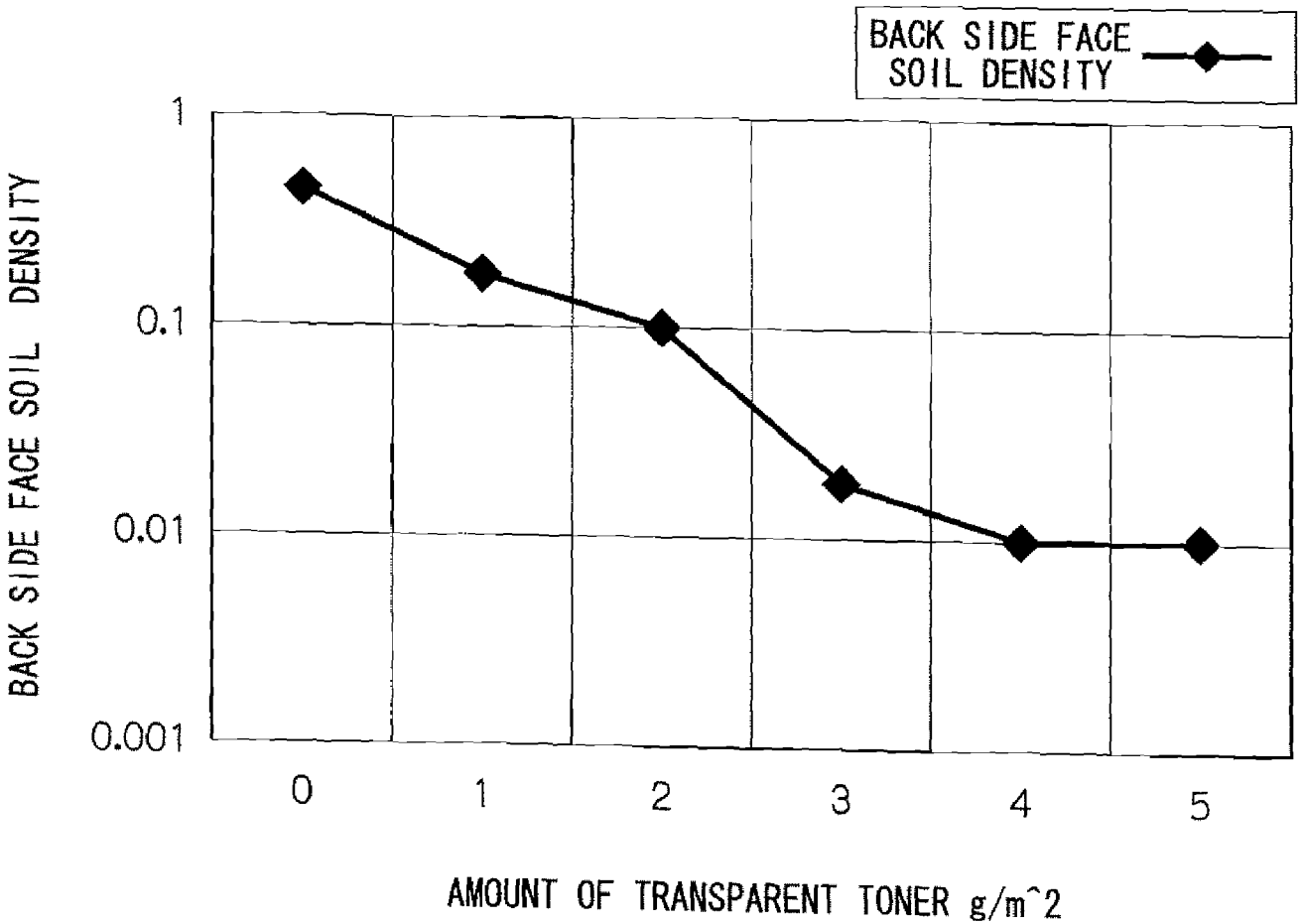
FIG. 7 is a graph for explaining the effect of an image forming apparatus according to an exemplary embodiment of the present invention.

FIG. 7 shows that, in a case in which there is no transparent toner image 68 formed below the patch images 56, the back side face dirty density (rate of a portion in the sheet that is soiled relative to the whole of the sheet) is 0.8, however, the back side face dirty density is reduced by forming the transparent toner image 68 below the patch images 56. It can be seen that in a case in which the amount of transparent toner is 3 $g/m^2$ or above, the back side face dirty density becomes 0.03 or less, and substantially no dirty occurs on the back side face of the paper.

It should be noted that, whereas in the present exemplary embodiment, as shown in FIG. 1, the image forming unit 12T is disposed upstream side of the image forming unit 12Y in the transporting direction of the intermediate transfer belt 16, there is, however, no limitation so such a configuration, as long as the transparent toner image 68 is adhered between the patch images 56 and the paper separation belt 48.

Figure 8:
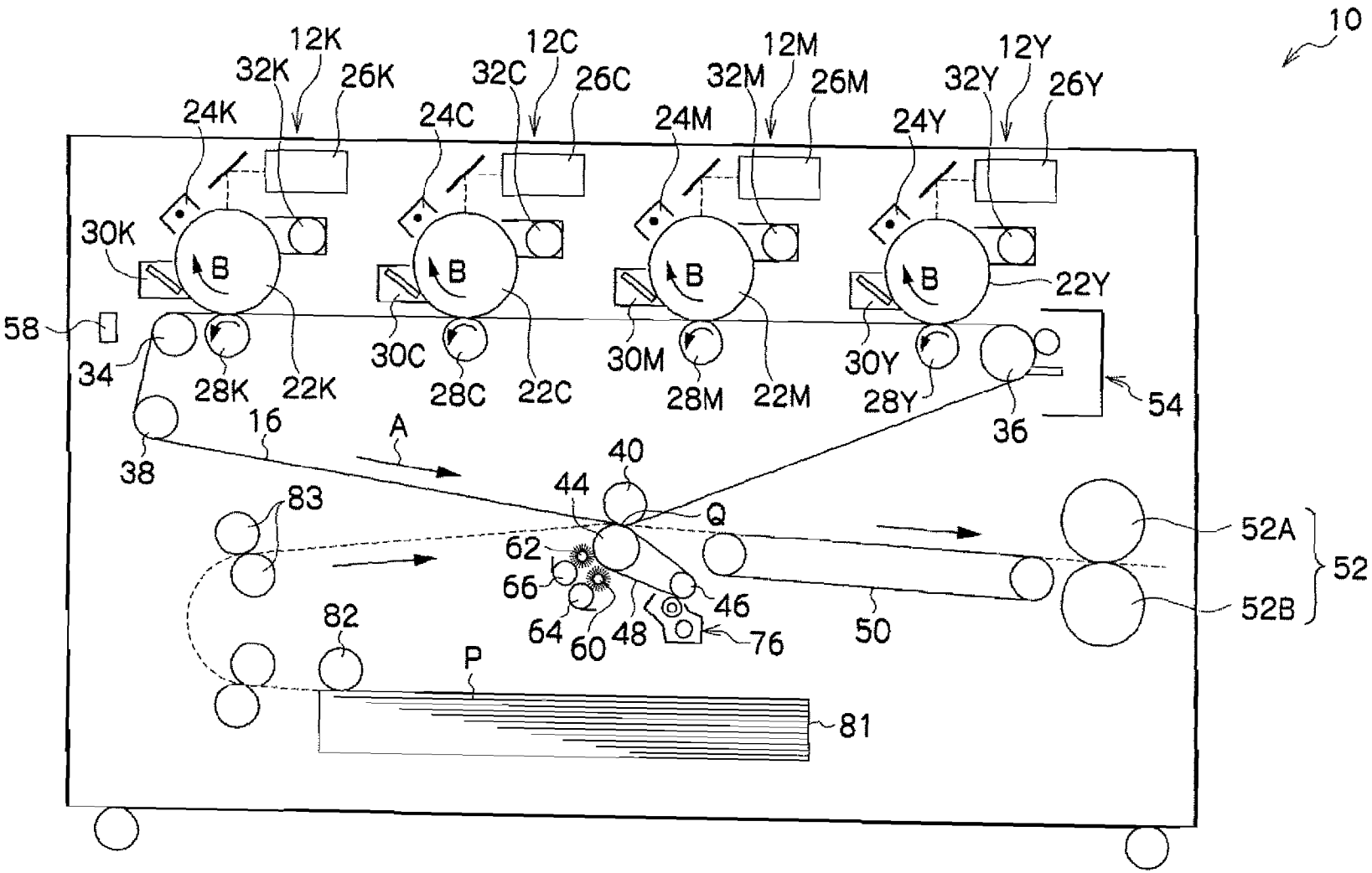
FIG. 8 is an outline view showing a configuration of a first modification of an image forming apparatus according to an exemplary embodiment of the present invention.
Figure 9:
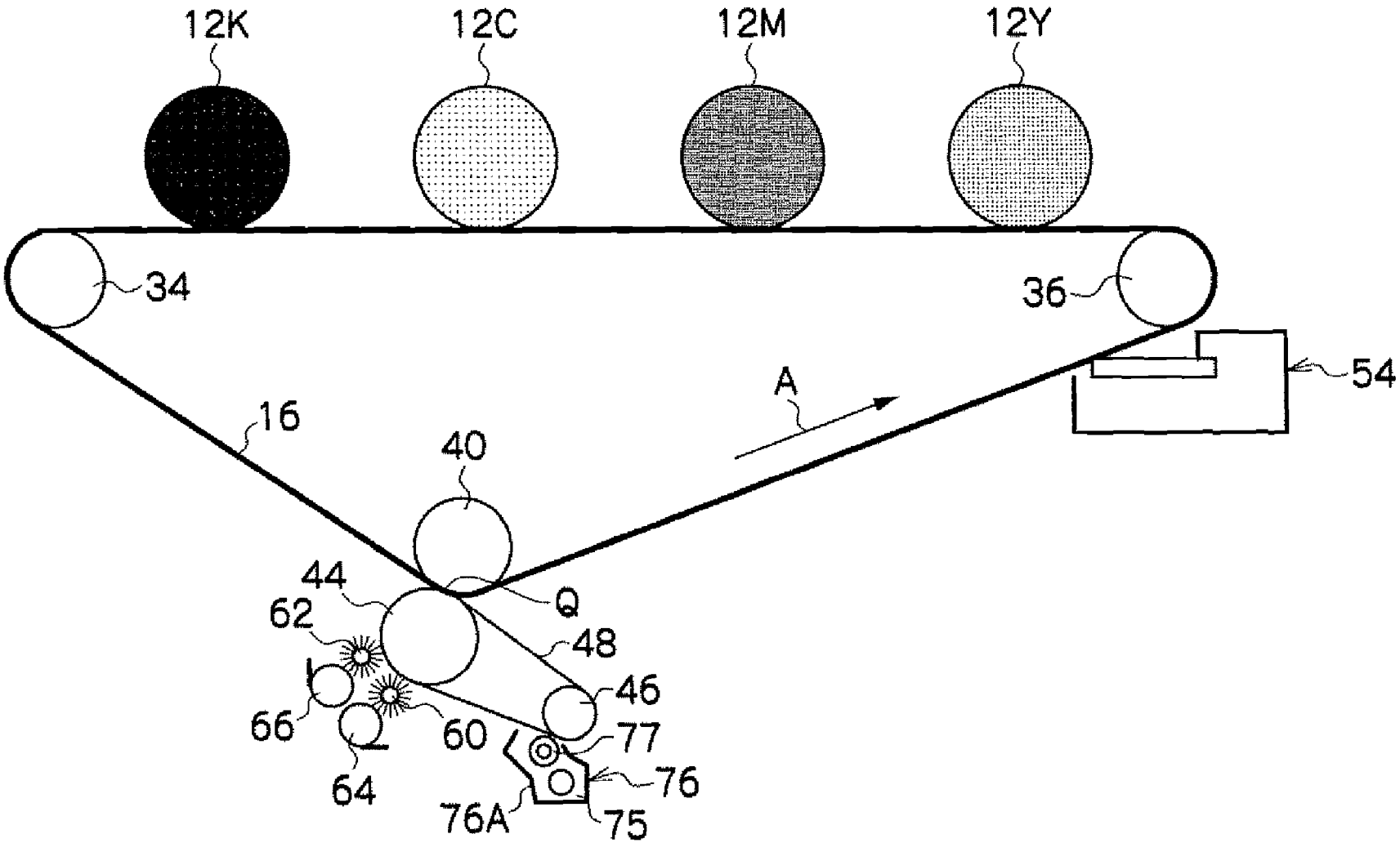
FIG. 9 is a side view showing relevant portions of a first modification of an image forming apparatus according to an exemplary embodiment of the present invention.

For example, as shown in FIG. 8 and FIG. 9, the image forming units 12Y, 12M, 12C, and 12K only may be disposed along the transporting direction of the intermediate transfer belt 16 above the intermediate transfer belt 16, and a toner supply device 76 that supplies transparent toner may be disposed in the vicinity of the support roll 46, facing the paper separation belt 48.

Figure 10:
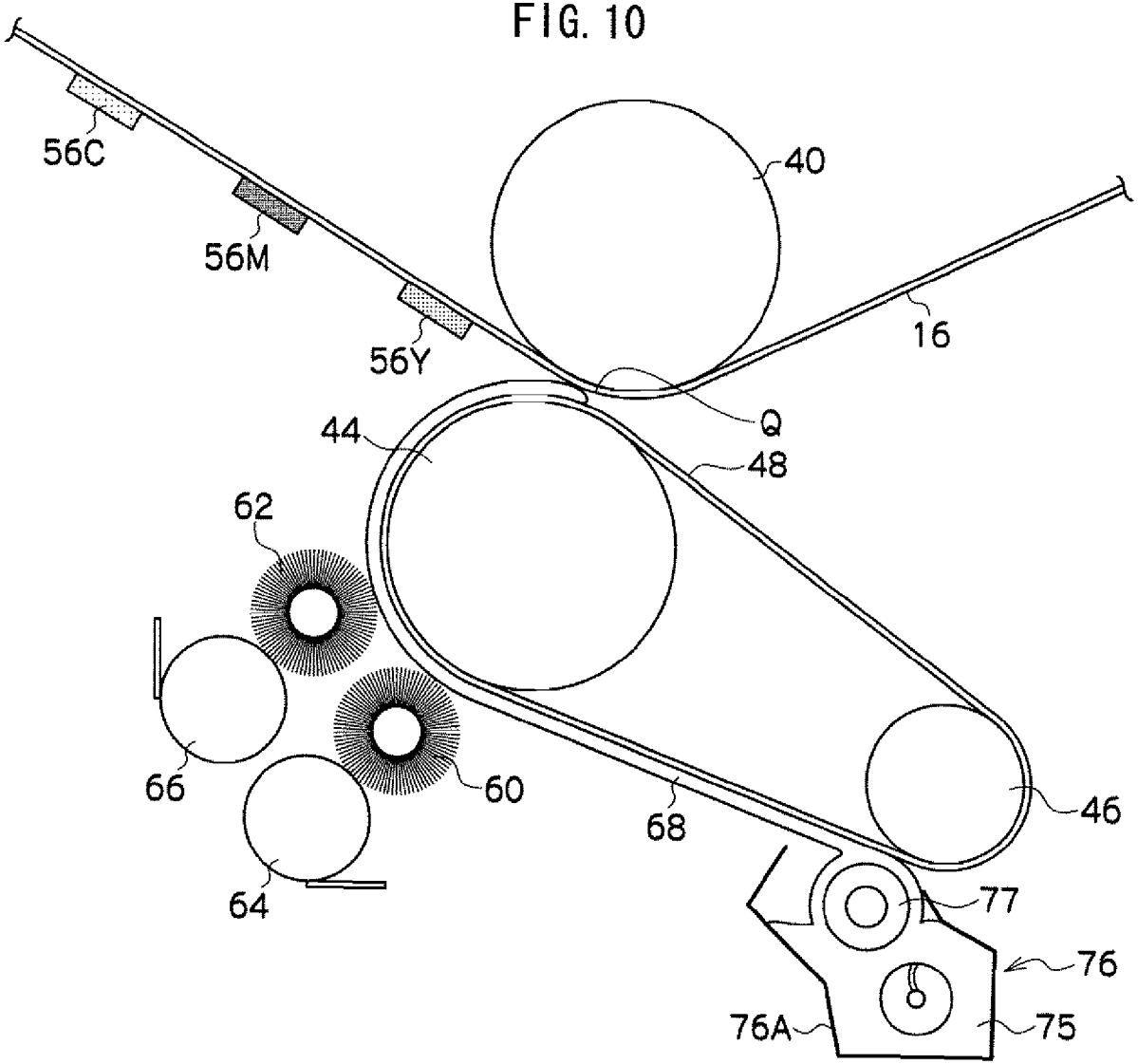
FIG. 10 is an enlarged view of FIG. 9, for explaining the operation of a first modification of an image forming apparatus according to an exemplary embodiment of the present invention.
Figure 11:
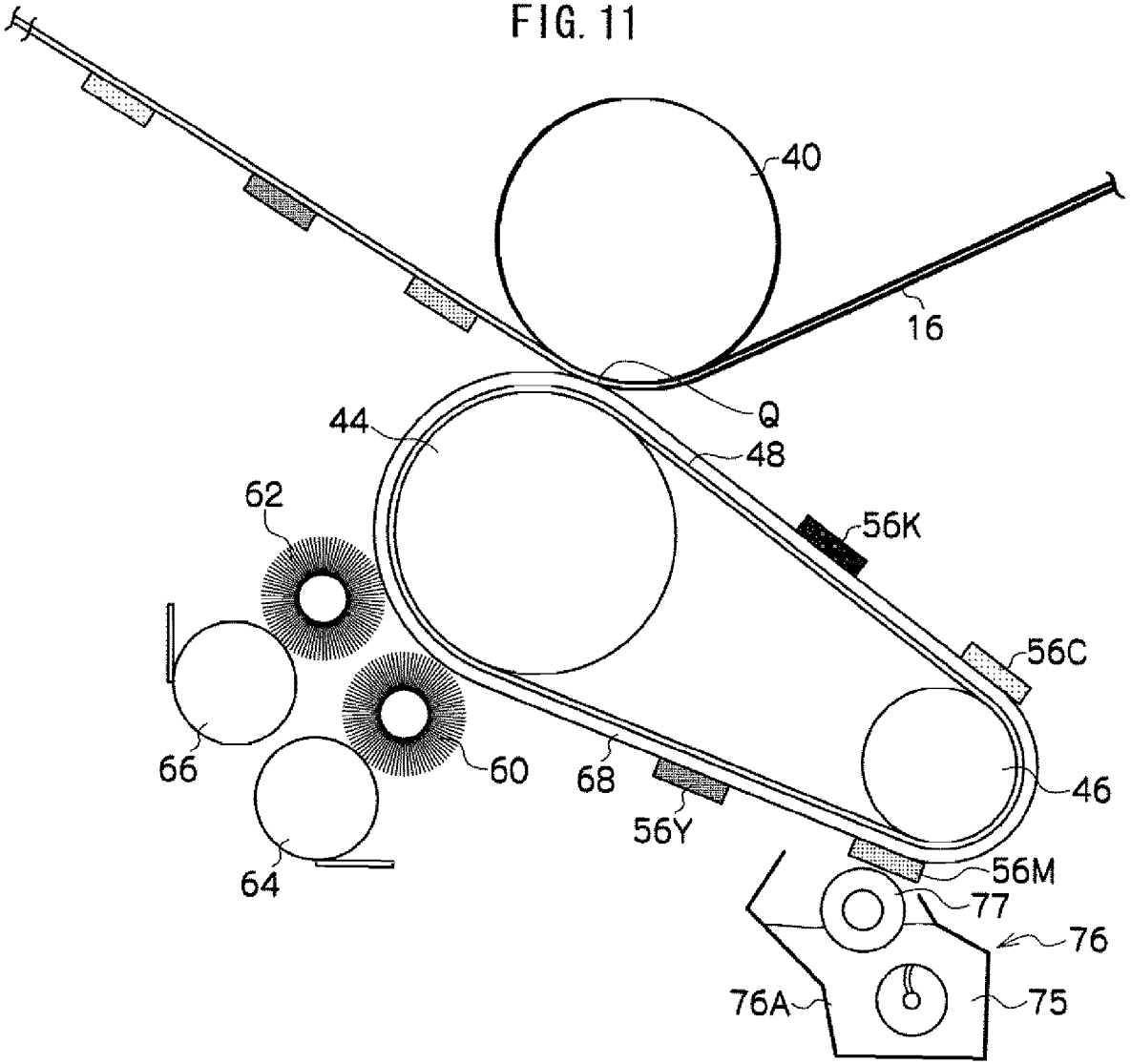
FIG. 11 is an enlarged view of FIG. 9, for explaining the operation of a first modification of an image forming apparatus according to an exemplary embodiment of the present invention.

As shown in FIG. 10, there is a photoreceptor 77 provided in the toner supply device 76 that charges up and holds the transparent toner 75. On the other hand, a voltage is applied to the support roll 46 with the reverse polarity with respect to that of the transparent toner 75, so the transparent toner is supplied to the paper separation belt 48. In such a case, a transparent toner image 68 is supplied in advance onto the paper separation belt 48 by the toner supply device 76 before the patch images 56 are transferred to the paper separation belt 48 from the intermediate transfer belt 16. Thereby, as shown in FIG. 11, the patch images 56 are transferred onto the transparent toner image 68.

In such cases, since all that is required is to supply transparent toner, a simplification of the structure may be achieved the cost is reduced in comparison to a case of the toner supply device 76 being as an image forming unit. The apparatus may also be made more compact.

Furthermore, the paper separation belt 48 is used in the secondary transfer unit 42, however, such a paper separation belt 48 is not always necessary, as long as the paper, onto which the toner image on the intermediate transfer belt 16 has been secondary-transferred, is separated from the intermediate transfer belt 16 and guided to the transporting belt 50.

Figure 12:
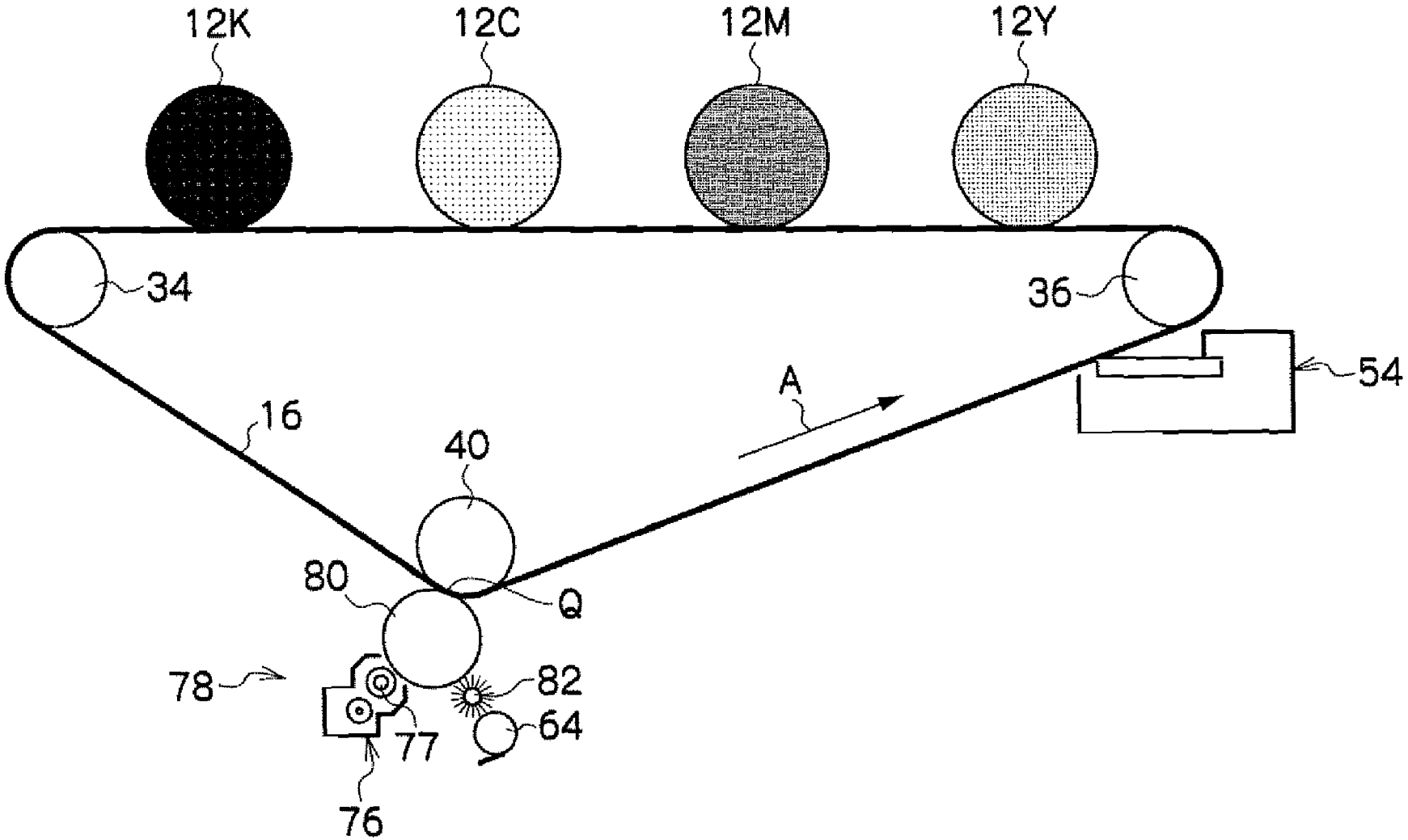
FIG. 12 is a side view showing relevant portions of a second modification of an image forming apparatus according to an exemplary embodiment of the present invention.
Figure 13:
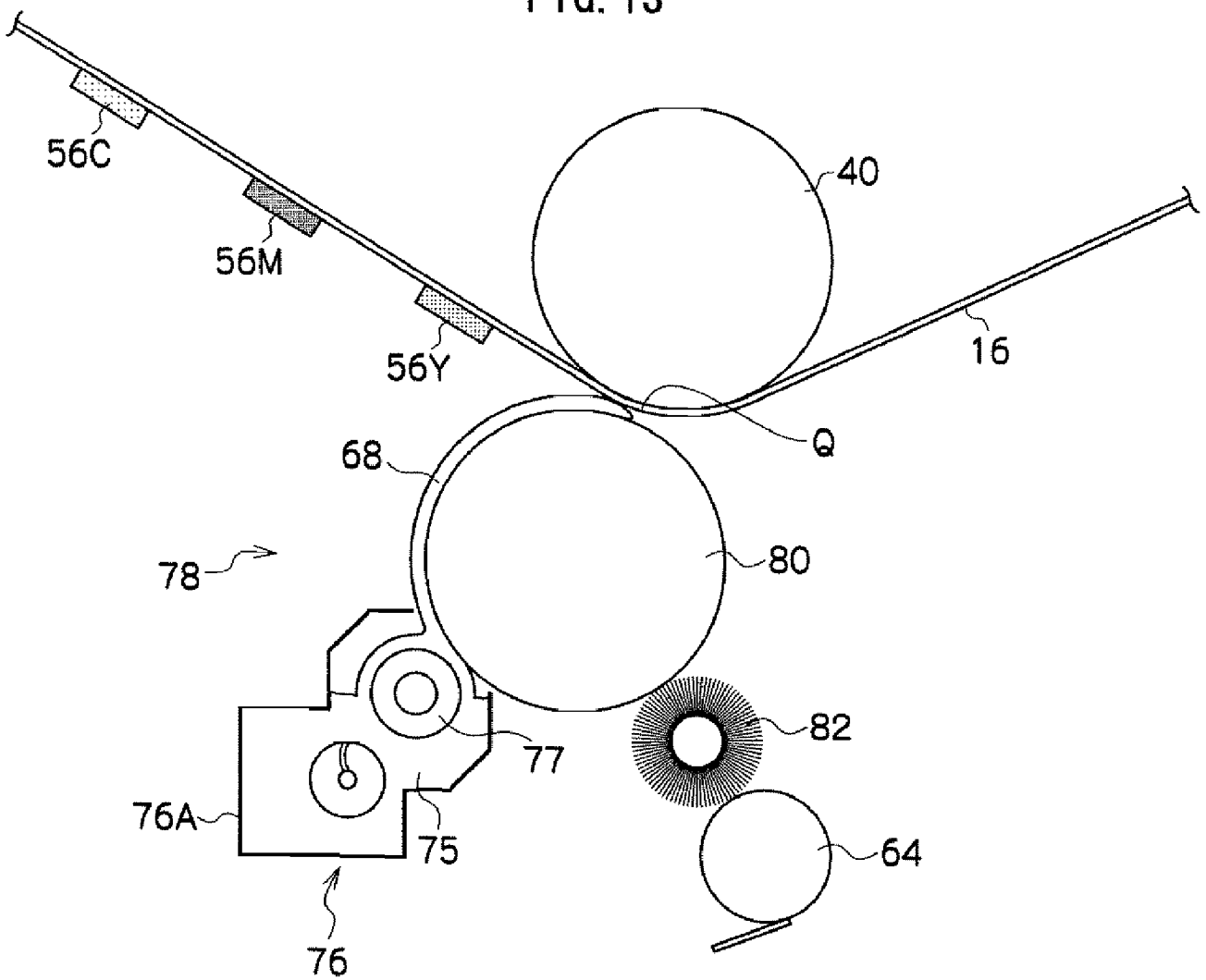
FIG. 13 is an enlarged view of FIG. 12, for explaining the operation of a second modification of an image forming apparatus according to an exemplary embodiment of the present invention.

For example, as shown in FIG. 12 and FIG. 13, only a secondary transfer roll 80 may be used as a secondary transfer unit 78, and the toner supply device 76 is disposed so as to face the secondary transfer roll 80 at a position downstream of the secondary transfer portion Q in the rotation direction of the secondary transfer roll 80. The transparent toner image 68 is then formed directly on the surface of the secondary transfer roll 80 by the toner supply device 76. Furthermore, a biasing brush 82 is disposed downstream of the secondary transfer portion Q but upstream of the toner supply device 76 in the rotation direction of the secondary transfer roll 80.

It is possible that, when all of the patch images 56 are transferred onto the transparent toner image 68 or onto a white toner, a bias of the same polarity to that of the patch images 56 is applied to the secondary transfer roll 80.

It should be noted that, whereas in the present exemplary embodiment, the transparent toner is used as an adhesion force reducing agent, there is no limitation to such, as long as the adhesion force of the patch images 56 to the paper separation belt 48 (or to the secondary transfer roll 80) is reduced and dirty of the back side face of the paper P is reduced.

For example, a white toner may be used instead of the transparent toner. Also, a release agent with a small adhesion force to the patch images 56 may be applied to the surface of the paper separation belt 48, between the paper separation belt 48 and the patch images 56, so the adhesion force to the paper separation belt 48 becoming greater than the adhesion force to the patch images 56.

Also, in the present exemplary embodiment, as shown in FIG. 1, explanation has been given of an example of a tandem type image forming apparatus 10, provided with a photoreceptor drum 22 for each of the image forming units 12 of respective colors, with the respective image forming units 12 arrayed in a row along the transporting direction of the intermediate transfer belt 16, however, the present invention may be applied to a so-called rotary type image forming apparatus 100.

Figure 14:
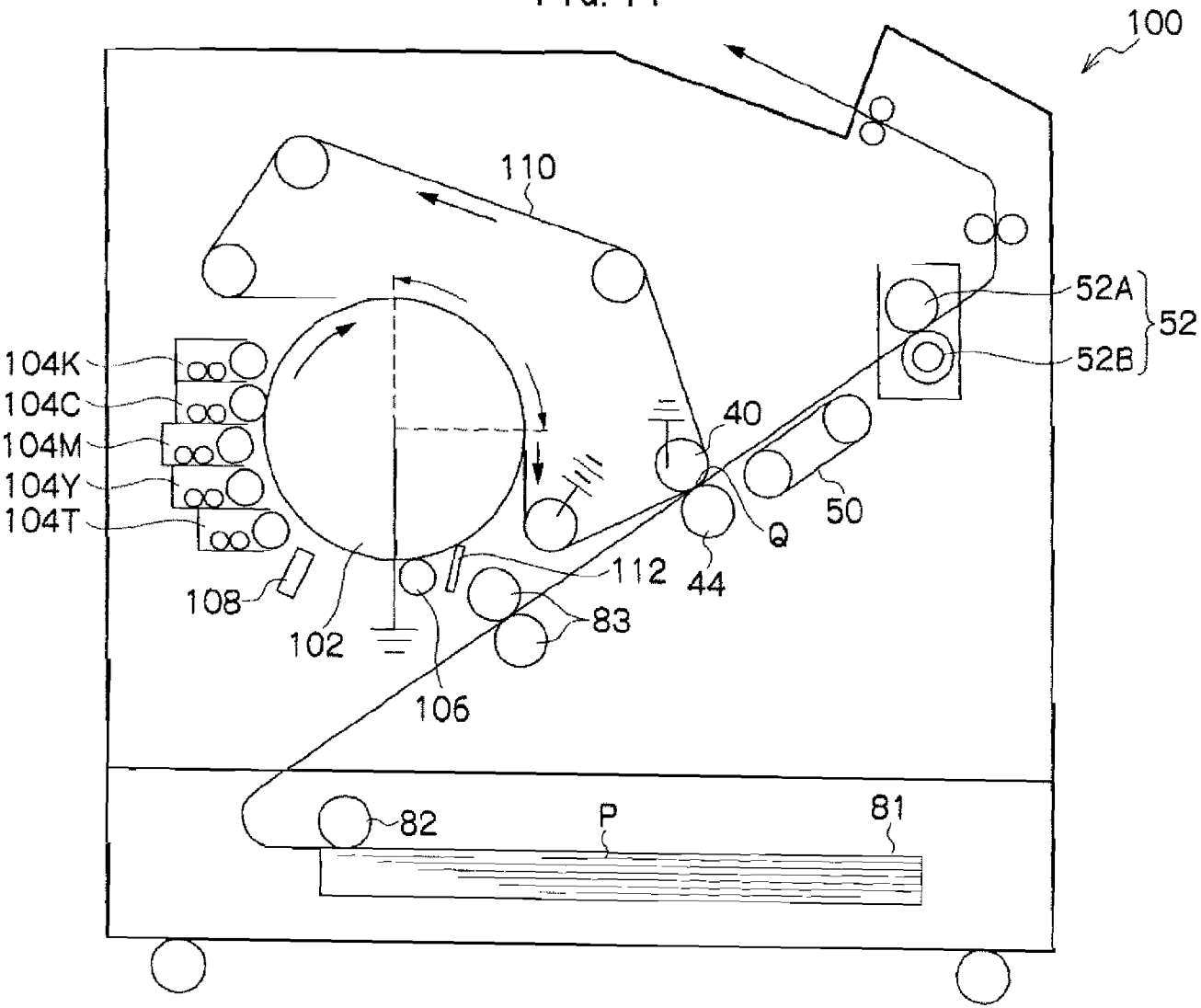
FIG. 14 is an outline view showing a configuration of a variation of an image forming apparatus according to an exemplary embodiment of the present invention.

The rotary type image forming apparatus 100, for example as shown in FIG. 14 (substantially similar contents to that of the image forming apparatus 10 will be omitted in the explanation), may be used in which there is provided a single photoreceptor drum 102, with developing units 104Y, M, C, K (yellow (Y), magenta (M), cyan (C) and black (K)) that accommodate each of the component colors disposed around the periphery of the photoreceptor drum 102, and that facing the photoreceptor drum 102, and electrostatic latent image may be formed on the photoreceptor drum 102.

Furthermore, whilst not illustrated in the drawings, the developing units 104Y, M, C, K may be provided so as to be mounted to a rotating body, and plural color developing units may be made to face the photoreceptor drum 102 in sequence by rotating the rotating body.

A developing unit 104T (application unit) that forms a transparent toner image is also disposed, in addition to the developing units 104Y, M, C, K, and to the upstream side of the developing unit 104Y in the rotation direction of the photoreceptor drum 102.

At the periphery of the photoreceptor drum 102, there are disposed, to the upstream side of the developing units 104, in the rotation direction of the photoreceptor drum 102, a charging device 106 that charges the photoreceptor drum 102, and an exposing unit 108 that writes electrostatic latent images onto the charged photoreceptor drum 102 for each of the color components.

The photoreceptor drum 102 contacts an intermediate transfer belt 110 to the downstream side of the developing units 104 in the rotation direction of the photoreceptor drum 102, and there is a cleaning device 112 disposed to the downstream side of that contact point, for cleaning toner remaining on the photoreceptor drum 102.

Substantially the same effects is obtained with the rotary type image forming apparatus 100 as are obtained in the tandem type image forming apparatus 10.

What is claimed is:

1. An image forming apparatus comprising:

an image carrier that holds a toner image;

an intermediate transfer member onto which the toner image that has been held on the image carrier is transferred;

a transfer unit that transfers onto a recording medium the toner image that has been transferred onto the intermediate transfer member, the transfer unit transferring thereon a color toner image for checking the toner image, which has been formed in a non-image forming region on the intermediate transfer member;

an application unit that applies an adhesion force reducing agent to a surface of the transfer unit before the color toner image for checking the toner image formed on the intermediate transfer member passes through the transfer unit such that the color toner image for checking the toner image is transferred onto the adhesion force reducing agent applied on the surface of the transfer unit, the adhesion force reducing agent reducing adhesion force to the transfer unit of the color toner image for checking the toner image; and a cleaning unit that removes the color toner image for checking the toner image that has been transferred onto the transfer unit and the adhesion force reducing agent.

2. The image forming apparatus of claim 1, wherein the application unit applies the adhesion force reducing agent to the intermediate transfer member at a region that is at a downstream side, in a moving direction of the intermediate transfer member, with respect to a region to which the color toner image for checking the toner image is transferred.

3. The image forming apparatus of claim 1, wherein the application unit directly applies the adhesion force reducing agent to the transfer unit at a region to which the color toner image for checking the toner image is to be transferred.

4. The image forming apparatus of claim 1, wherein the transfer unit includes a separation belt that wraps around a transfer roll that transfers the toner image on the intermediate transfer member onto the recording medium, the separation belt separates the recording medium from the intermediate transfer member, and on the separation belt, color toner image for checking the toner image is transferred onto the adhesion force reducing agent.

5. The image forming apparatus of claim 1, wherein the transfer unit includes a transfer roll that transfers the toner image on the intermediate transfer member onto the recording medium, and the color toner image for checking the toner image is transferred onto the transfer roll.

6. The image forming apparatus of claim 1, wherein the cleaning unit includes a conductive cleaning member.

7. The image forming apparatus of claim 1, wherein the adhesion force reducing agent is one of a transparent toner or a white toner.

8. The image forming apparatus of claim 7, wherein a bias of the same polarity as that of the transparent toner or the white toner is applied to the cleaning unit up until the time when all of the color toner image for checking the toner image is transferred onto the transparent toner or onto the white toner.

9. The image forming apparatus of claim 7, wherein when all of the color toner image for checking the toner image is transferred onto the transparent toner or onto the white toner, a bias of reverse polarity with respect to that of the color toner image for checking the toner image is applied to the cleaning unit.

10. The image forming apparatus of claim 2, wherein the application unit is disposed at an upstream side, in the moving direction of the intermediate transfer member, with respect to the transfer unit such that the adhesion force reducing agent is transferred from the intermediate transfer member to the transfer unit.

11. The image forming apparatus of claim 3, wherein the application unit is disposed in the vicinity of the transfer unit such that the application unit directly applies the adhesion force reducing agent to the transfer unit.

12. An image forming method comprising:

transferring a toner image that has been held on an image carrier onto an intermediate transfer member;

transferring onto a recording medium the toner image that has been transferred onto the intermediate transfer member;

transferring onto a transfer unit a color toner image for checking the toner image which has been formed in a non-image forming region on the intermediate transfer member;

applying an adhesion force reducing agent to a surface of the transfer unit before the color toner image for checking the toner image formed on the intermediate transfer member passes through the transfer unit, such that the color toner image for checking the toner image is transferred onto the adhesion force reducing agent applied on the surface of the transfer unit, the adhesion force reducing agent reducing adhesion force to the transfer unit of the color toner image for checking the toner image; and removing the color toner image for checking the toner image that has been transferred onto the transfer unit and the adhesion force reducing agent.

13. The image forming method of claim 12, wherein the adhesion force reducing agent is applied to the intermediate transfer member at a region that is at a downstream side, in a moving direction of the intermediate transfer member, with respect to a region to which the color toner image for checking the toner image is transferred.

14. The image forming method of claim 12, wherein the adhesion force reducing agent is directly applied to the transfer unit at a region to which the color toner image for checking the toner image is to be transferred.

15. The image forming method of claim 12, wherein the transfer unit includes a separation belt that wraps around a transfer roll that transfers the toner image on the intermediate transfer member onto the recording medium, the separation belt separates the recording medium from the intermediate transfer member, and on the separation belt, color toner image for checking the toner image is transferred onto the adhesion force reducing agent.

16. The image forming method of claim 12, wherein the transfer unit includes a transfer roll that transfers the toner image on the intermediate transfer member onto the recording medium, and the color toner image for checking the toner image is transferred onto the transfer roll.

17. The image forming method of claim 12, wherein a cleaning unit removes the color toner image for checking the toner image and the adhesion force reducing agent, and includes a conductive cleaning member.

18. The image forming method of claim 12, wherein the adhesion force reducing agent is one of a transparent toner or a white toner.

19. The image forming method of claim 18, wherein a bias of the same polarity as that of the transparent toner or the white toner is applied to the cleaning unit up until the time when all of the color toner image for checking the toner image is transferred onto the transparent toner or onto the white toner.

20. The image forming method of claim 18, wherein when all of the color toner image for checking the toner image is transferred onto the transparent toner or onto the white toner, a bias of reverse polarity with respect to that of the color toner image for checking the toner image is applied to the cleaning unit.

* * * * *